US007380498B2

(12) United States Patent
Domotor

(10) Patent No.: US 7,380,498 B2
(45) Date of Patent: Jun. 3, 2008

(54) OFFSET LITHOGRAPHY SYSTEM

(76) Inventor: Julius Domotor, 381 Courtland Dr., San Bruno, CA (US) 94066

( * ) Notice: Subject to any disclaimer, the term of this patent is extended or adjusted under 35 U.S.C. 154(b) by 0 days.

(21) Appl. No.: 11/514,002

(22) Filed: Aug. 30, 2006

(65) Prior Publication Data

US 2008/0053322 A1 Mar. 6, 2008

(51) Int. Cl.
*B41F 7/20* (2006.01)
*B41F 7/02* (2006.01)

(52) U.S. Cl. ..... 101/350.3; 101/350.4

(58) Field of Classification Search ..... None
See application file for complete search history.

(56) References Cited

U.S. PATENT DOCUMENTS 4,044,674 A * 8/1977 Smith, Jr. ..... 101/148
4,397,236 A * 8/1983 Greiner et al. ..... 101/350.3
5,823,109 A * 10/1998 Hummel et al. ..... 101/350.4

* cited by examiner

*Primary Examiner*—Daniel J Colilla
(74) *Attorney, Agent, or Firm*—Thomas R. Lampe

(57) ABSTRACT

The inking system of an offset lithography press incorporates certain rollers running at different speeds. The hard rollers do not oscillate and the form rollers and the soft transfer rollers of the inking system oscillate endways.

19 Claims, 3 Drawing Sheets

OFFSET LITHOGRAPHY SYSTEM

TECHNICAL FIELD

This invention relates to the field of offset lithography, and more particularly to an offset lithography press and a method for improving the performance of an offset lithography press.

BACKGROUND OF THE INVENTION

The operation of lithographic printing presses involves an interaction of water and ink and the inking system of the lithographic printing process has not changed in any fundamental way since the invention of the offset lithographic press in the early 20th century.

Conventional prior art inking systems employed in offset lithography typically include a series of rollers which deliver ink from an ink source to a rotatable plate cylinder carrying the image to be printed. A dampening unit is utilized in association with the plate cylinder to deliver water to the plate cylinder.

The inking unit of a conventional offset lithography press incorporates different types of rollers. A plurality of form rollers are disposed between and in engagement with a rotating plate cylinder and friction driven thereby. The hard rollers engaging the form rollers are oscillated endways. The surface speeds of the hard rollers, the plate cylinder and the form rollers are the same.

The typical inking unit also includes a second set of hard oscillating rollers in operative association with transfer rollers between the first set of hard oscillating rollers and the second set of hard oscillating rollers to deliver ink from the source of ink to the soft rubber form rollers engaging the plate cylinder. All of the transfer rollers are friction driven and all of the rollers in the inking unit, including the hard oscillating-rollers, the transfer rollers and the form rollers have the same surface speed. The endways oscillation of all of the hard oscillating rollers promotes ink distribution.

Conventional offset lithography presses develop problems when run at high speeds. Inking rollers of such equipment with a 3 inch diameter, for example, rotate up to a speed of 3,500 RPM or 46 feet per second surface speed.

As will be described in greater detail below, one of the problems encountered is misting, that is airborne microscopic balls of ink. Undesirable side effects are ink run off and starvation on the printing form.

DISCLOSURE OF INVENTION

The present invention relates to an offset lithography press and method for improving the performance of an offset lithography press wherein misting is virtually eliminated even at very high operational speeds. Ink run off and starvation on the printing form are also virtually eliminated at high operational speeds.

The offset lithography press of the present invention includes a plate cylinder rotating at a plate cylinder surface speed. A plurality of form rollers are in engagement with the plate cylinder.

Form roller drive structure is provided to positively drive the form rollers and rotate the form rollers at a surface speed substantially equal to the plate cylinder surface speed.

First hard rollers are spaced from the plate cylinder and in contact with the form rollers. First hard roller drive structure positively drives the first hard rollers at a surface speed slower than the surface speed of the form rollers and the plate cylinder surface speed.

Another aspect of the invention is that the hard rollers of the inking unit of the press are non-oscillating. Instead, the transfer rollers and form rollers are oscillated endways to provide very effective ink distribution.

The method of the invention is for improving the performance of an offset lithography press having a rotating plate cylinder, a plurality of rotatable form rollers in engagement with the rotating plate cylinder and rotatable first hard rollers in contact with the rotatable form rollers.

The form rollers are positively driven at a surface speed substantially equal to the plate cylinder surface speed and the hard rollers are positively driven at a surface speed slower than the surface speed of the form rollers and the plate cylinder surface speed.

In addition, oscillation of the hard rollers is prevented and the form rollers and transfer rollers are oscillated endways.

Other features, advantages and objects of the present invention will become apparent with reference to the following description and accompanying drawings.

BEST MODE FOR CARRYING OUT THE INVENTION

Figure 1:
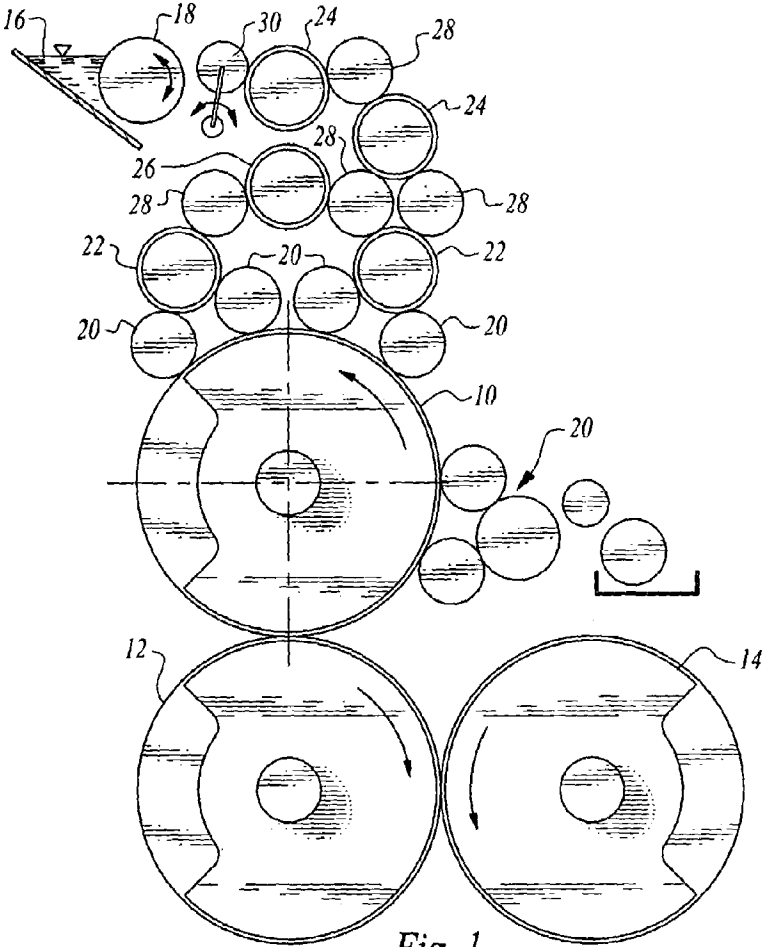
Fig. 1 (Prior Art)
FIG. 1 is a schematic presentation of a typical offset lithography press construction including the inking unit thereof comprised of a plurality of rollers between an ink source and a rotating plate cylinder.

FIG. 1 illustrates a typical prior art inking system employed in an offset lithography press, the press including a rotating plate cylinder 10 which carries the image, a blanket cylinder 12 which transfers ink to paper and an impression cylinder 14 which carries paper that receives ink from the blanket cylinder.

The press also includes a source of ink including an ink fountain 16 and an ink supply roll 18. A dampening unit 20 for supplying water to the surface of the plate cylinder is also included in the press.

A plurality of rollers are disposed between the ink supply roll 18 to deliver ink from the ink fountain to the outer surface of plate cylinder 10.

These rollers include soft rubber form rollers 20 engaging the outer surface of the plate cylinder and a pair of first hard rollers 22 engaging the form rollers 20.

Additional rollers include two second hard rollers 24, one hard transfer roller 26 and four soft rubber transfer rollers 28. A pivotally mounted applicator drum 30 is employed to selectively apply ink to the topmost second hard roller 24.

As will be seen below, the overall configuration shown in FIG. 1 is the same in the prior art offset lithography press as in an offset lithography press incorporating the teachings of the present invention.

In the prior art press, all of the rollers 20, 22, 24, 26 and 28 run at the same surface speed as the surface speed of rotatably driven plate cylinder 10. In the prior art hard rollers 22, 24 are gear driven and run at the same surface speed as the plate cylinder's surface speed. In the prior art, the form rollers 20 are friction driven by the first hard rollers 22 and the plate cylinder 10. The transfer rollers 26, 28 are friction driven by the first and second hard rollers 22, 24. Again, all rollers have the same surface speed as the plate cylinder in the conventional prior art offset lithography press.

In the conventional offset lithography press, the first and second hard rollers 22, 24 oscillate endways both right and left to promote the even distribution of ink.

Figure 5:
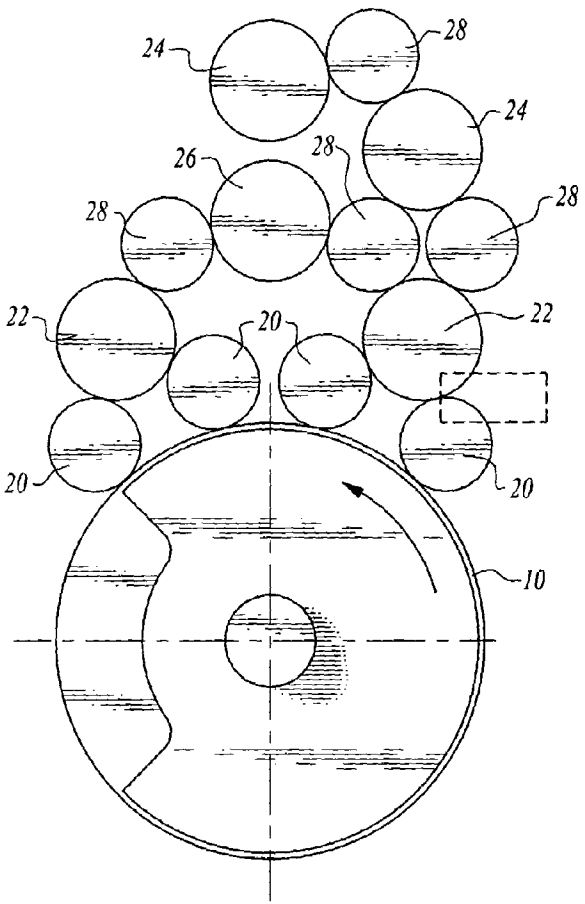
Fig. 5 (Prior Art)
FIG. 5 is a diagrammatic illustration showing only the plate cylinder and inking unit rollers of the offset lithography press.

In interest of simplicity, FIG. 5 shows only the plate cylinder 10 and the rollers 20, 22, 24, 26 and 28.

Use of the conventional prior art offset lithography press inking system discussed above can cause misting, ink run off and starvation on a printing form when run at high speeds. It is not uncommon for inking rollers having a 3 inch diameter to be rotated at speeds up to a speed of 3,500 RPM or 46 feet per second surface speed.

Figure 2:
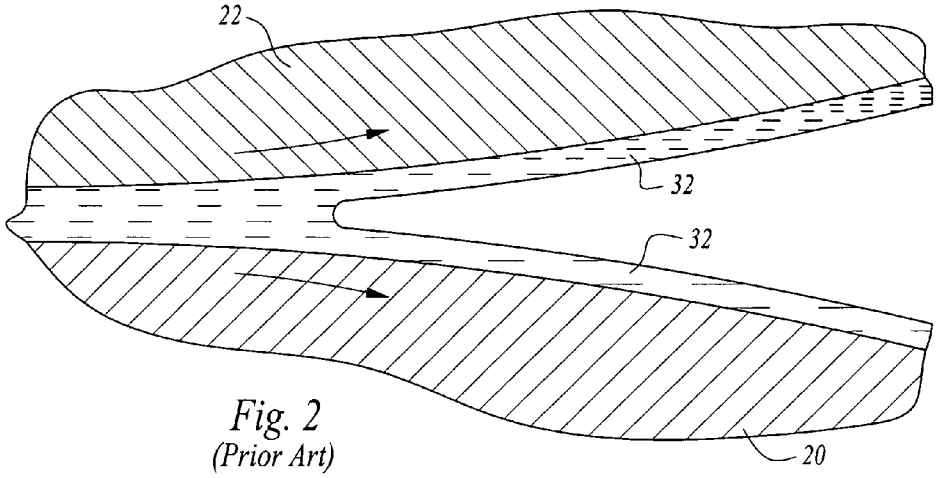
Fig. 2 (Prior Art)
FIG. 2 is a greatly enlarged, cross-sectional view illustrating portions of a hard oscillating roller as employed in typical prior offset lithography press arrangements in association with a non-oscillating soft rubber form roller illustrating the split of ink as the two rollers roll apart from the nip under slow speed conditions.
Figure 3:
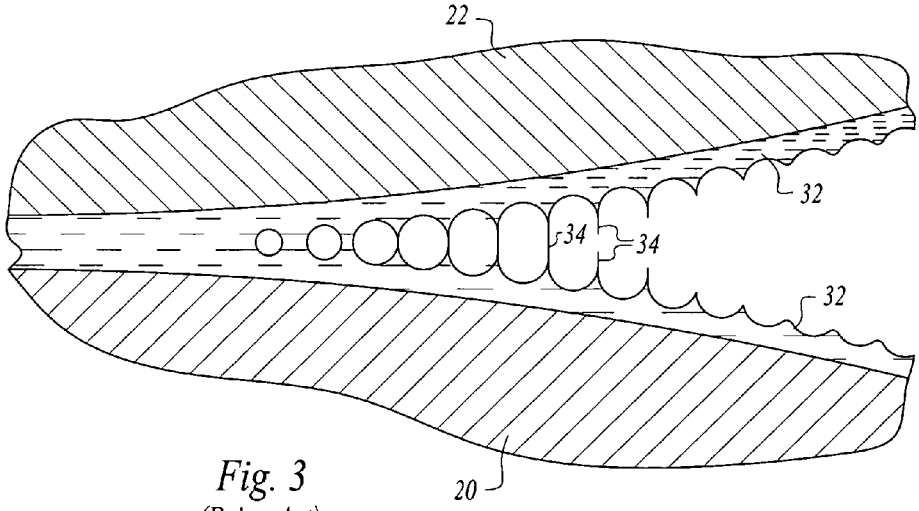
Fig. 3 (Prior Art)
FIG. 3 is a view similar to FIG. 2, but illustrating what happens at medium roller speed when ink cavitates and cavitation breaks, but with the broken filaments of the ink remaining attached to the rollers.
Figure 4:
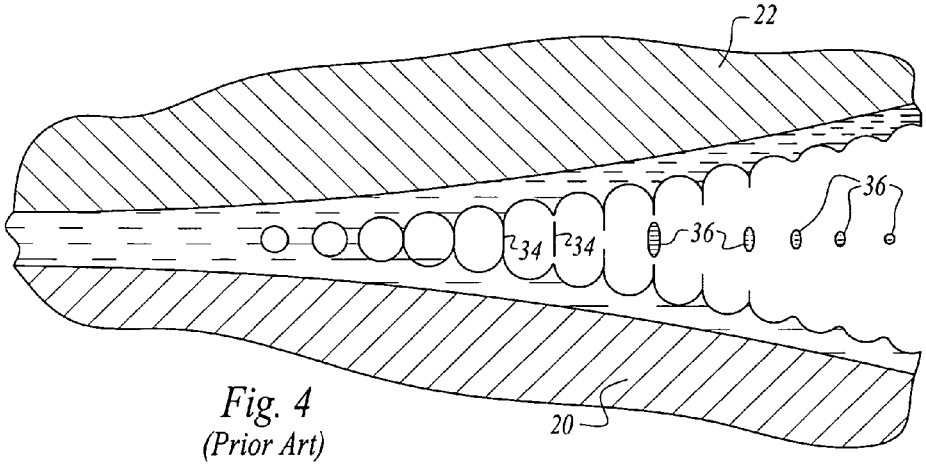
Fig. 4 (Prior Art)
FIG. 4 is a view similar to FIGS. 2 and 3, but illustrating the rollers rolling apart at high speed, the ink splitting and the filaments breaking at both ends so that portions of the filaments become airborne to create misting.

FIGS. 2-4 illustrate the type of action that occurs in the prior art between one form roller 20 and a hard oscillating roller 22 when rotation occurs in the area defined by the dashlines in FIG. 5. It will be appreciated that the action on the ink shown in these figures is representative of what can occur between a number of pairs of adjacent rollers in the ink transfer system. As shown in FIG. 2, as the ink rollers roll apart from the nip, the ink 32 splits relatively smoothly when the ink rollers are operated at relatively slow speeds.

FIG. 3 illustrates what happens when the rollers are operated at relatively medium speeds. In this situation, the ink 32 cavitates as it splits. As the cavitations break, filaments 34 are formed, these splitting into two parts which remain positioned on the form roller 20 and the hard oscillating roller 22. When, however, the rollers roll apart at high speed, as illustrated in FIG. 4, the filaments 34 break at both ends and parts of the filaments become airborne. The free portions of the filaments due to cohesive forces change shape and form microscopic balls 36. These balls fly off into the air and create misting. The microscopic ink particles become deposited on various surfaces including those of press parts and create a mess. At higher speeds, ink splits can also form a pebbly finish on the rollers that becomes visible in certain colors.

An offset lithography press constructed in accordance with the teachings of the present invention has the same general overall roller configuration as shown in FIGS. 1 and 5. However, the misting and other problems associated with the conventional press setup are obviated by making certain modifications to the conventional arrangement with regard to speed and other operational characteristics of the rollers.

Figure 6:
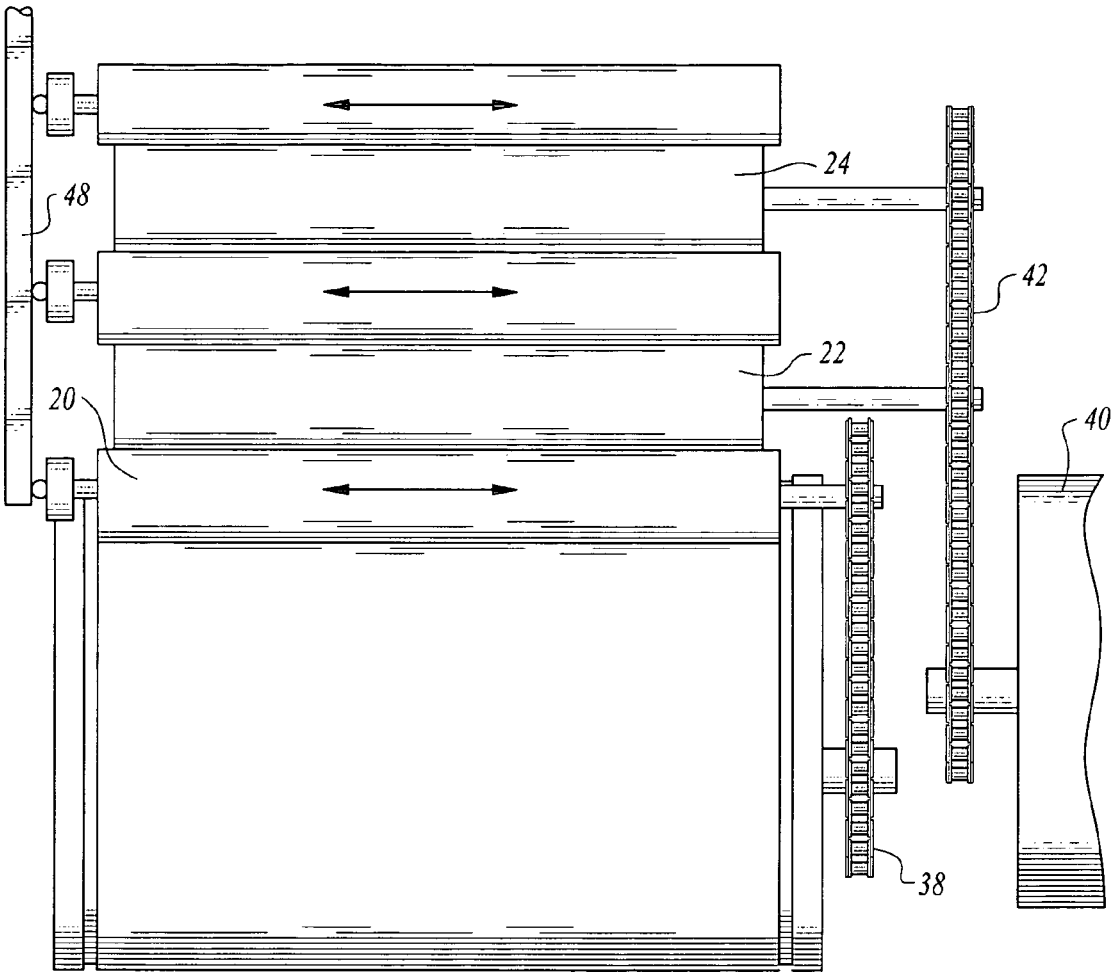
FIG. 6 is a frontal, diagrammatic view illustrating positive drive and endways oscillation of certain of the rollers in accordance with the teachings of the present invention.

Utilizing the teachings of the present invention, the form rollers 20 are positively driven at the same surface speed as the plate cylinder surface speed. FIG. 6 shows one of the form rollers 20 positively rotatably driven by a drive chain 38 connected to a shaft of the rotating plate cylinder 10 (FIG. 6). The three other form rollers are likewise positively rotatably driven.

The first hard rollers 22 are positively driven by a drive chain 42 operatively associated with the motor 40. The hard rollers 22 are positively driven at a slower surface speed than the speed of the form rollers and the plate cylinder surface speed. Speed reduction of these rollers 22 may for example be in the range of from about 3 percent to about 75 percent of the speed of the form rollers.

The second hard rollers 24 are also positively driven, in the present arrangement by drive chain 42. The second hard rollers are further slowed down relative to the plate cylinder surface speed and they run slower than hard rollers 22. Speed reduction of hard rollers 24 may, for example, be in the range of from about 10 percent to about 95 percent. Transfer rollers 26, 28 are friction driven by adjacent rollers.

Another unique aspect of the present invention resides in the fact that the hard rollers 22, 24 do not oscillate as they do in the conventional offset lithography press. Instead, since oscillating is necessary for good ink distribution, oscillator structure 48 of any suitable type is employed to oscillate the four form rollers 20 and the four soft transfer rollers 28 sideways, for example about one inch left and right. In the conventional press, these rollers do not oscillate. This approach provides even better ink distribution since instead of four rollers, eight rollers oscillate.

Figure 7:
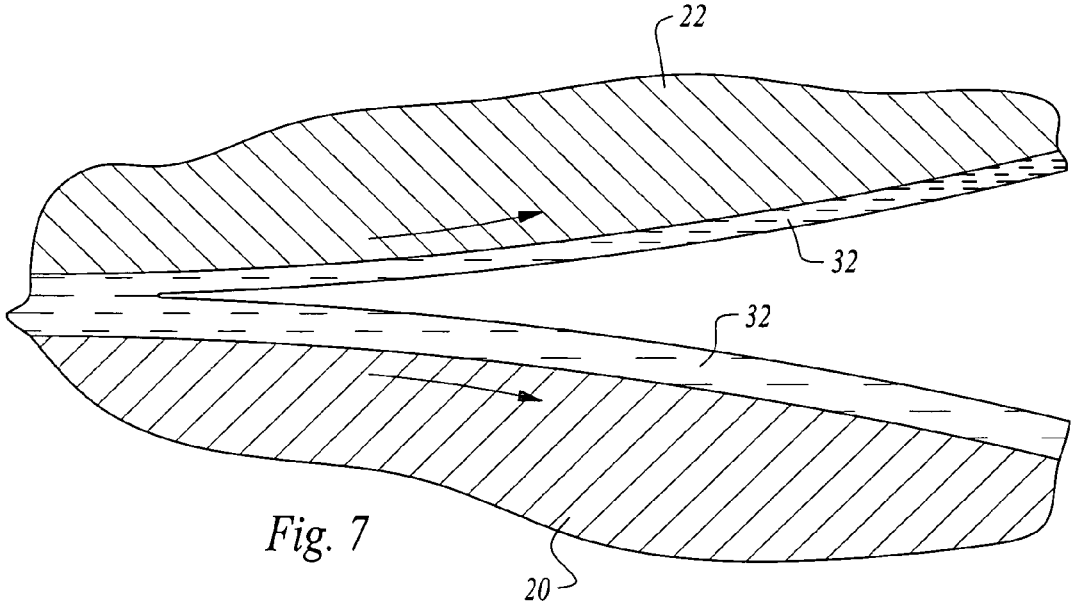
FIG. 7 is a view similar to FIGS. 2-4, but illustrating how the modifications of the present invention result in no misting, smooth ink lay and no run off, even at high speeds when utilizing the apparatus and method of the present invention.

FIG. 7 provides an illustration of the ink condition even during high speed operation when the modifications set forth above have been made to an offset lithography press. The variable speed reduction equipped inking unit essentially stops misting. There is an improved, smooth ink lay and there is no run off.

During practice of the invention, with the exception of the form rollers, all rollers are slowed down and run much slower than in conventional arrangements. Ink spreads, and does not split to form filaments. Both of these actions eliminate the formation of mist.

Since the ink actually spreads and does not split along filaments, a smooth ink surface is created. There is no formation of ink "pebbles" as in the prior art. Furthermore, form roller run off starvation is eliminated with the spreading ink transfer. Finally, the roller of a pair of rollers forming a nip having the faster surface speed carries a heavier charge of ink-normally about 15 to 20 percent more-than the slower speed roller. In FIG. 7 a nip is formed by a form roller 20 and a first hard roller 22. Since the form roller 20 is running at a faster speed, more ink will be applied thereto.

The invention claimed is:

1. An offset lithography press including, in combination:

a plate cylinder rotating at a plate cylinder surface speed;

a plurality of form rollers in engagement with said plate cylinder;

form roller drive structure positively driving said form rollers and rotating said form rollers at a surface speed substantially equal to the plate cylinder surface speed;

first hard rollers spaced from said plate cylinder in contact with said form rollers; and first hard roller drive structure positively driving said first hard rollers at a surface speed slower than the surface speed of said form rollers and said plate cylinder surface speed.

2. The offset lithography press according to claim 1 wherein said first hard rollers are positively driven at a surface speed in the range of from about 3 percent to about 75 percent less than the surface speed of said form rollers.

3. The offset lithography press according to claim 1 additionally including second hard rollers in operative association with said first hard rollers and located between said first hard rollers and an ink supply for delivering ink from said ink supply to said first hard rollers, and second hard roller drive structure driving said second hard rollers at a surface speed slower than the surface speed of said first hard rollers and said plate cylinder surface speed.

4. The offset lithography press according to claim 3 wherein said second hard rollers are positively driven at a surface speed in the range from about 10 percent to about 95 percent of the surface speed of said first hard rollers.

5. The offset lithography press according to claim 3 additionally including friction driven ink transfer rollers between said first hard rollers and said second hard rollers.

6. The offset lithography press according to claim 5 additionally including a friction driven transfer roller between adjacent second hard rollers.

7. The offset lithography press according to claim 6 wherein said first hard rollers and said second hard rollers are non-oscillating and wherein said offset lithography press additionally includes oscillator structure oscillating at least some of said transfer rollers endways relative to said first hard rollers, said second hard rollers and said plate cylinder.

8. The offset lithography press according to claim 6 wherein said first hard rollers and said second hard rollers are non-oscillating and wherein said offset lithography press additionally includes oscillator structure oscillating at least some of said form rollers endways relative to said first hard rollers, said second hard rollers and said plate cylinder.

9. The offset lithography press according to claim 6 wherein said first hard rollers and said second hard rollers are non-oscillating and wherein said offset lithography press additionally includes oscillator structure oscillating at least some of said transfer rollers and at least some of said form rollers endways relative to said first hard rollers, said second hard rollers and said plate cylinder.

10. The offset lithography press according to claim 9 wherein all of said form rollers and all of said transfer rollers are oscillated by said oscillator structure.

11. An offset lithography press including a rotating plate cylinder, an ink source, a plurality of rotating, non-oscillating hard rollers located between said rotating elate cylinder and said ink source, and a plurality of ink transfer rollers in operative association with said non-oscillating hard rollers to deliver ink from said ink source to said plate cylinder, at least one of said ink transfer rollers in engagement with at least one of said non-oscillating hard rollers and oscillating endways relative thereto.

12. A method for improving the performance of an offset lithography press having a rotating plate cylinder, a plurality of rotatable form rollers in engagement with said rotating plate cylinder and rotatable first hard rollers in contact with said rotatable form rollers, said method including the steps of:

positively driving said form rollers at a surface speed substantially equal to the plate cylinder surface speed; and positively driving said first hard rollers at a surface speed slower than the surface speed of said form rollers and said plate cylinder surface speed.

13. The method according to claim 12 wherein said first hard rollers are positively driven at a surface speed in the range of from about 3 percent to about 75 percent less than the surface speed of said form rollers.

14. The method according to claim 12 wherein said offset lithography press additionally includes second hard rollers in operable association with said first hard rollers and an ink supply for delivering ink from said ink supply to said first hard rollers, said method including driving said second hard rollers at a surface speed slower than the surface speed of said first hard rollers.

15. The method according to claim 14 wherein said second hard rollers are positively driven at a surface speed in the range of from about 10 percent to about 95 percent of the surface speed said first hard rollers.

16. The method according to claim 14 wherein said lithography press additionally includes a plurality of friction driven ink transfer rollers, said method additionally including the steps of preventing oscillation of said first hard rollers and said second hard rollers and oscillating at least some of said ink transfer rollers endways relative to said first hard rollers, said second hard rollers and said plate cylinder.

17. The method according to claim 14 including the steps of preventing oscillation of said first hard rollers and said second hard rollers and oscillating at least some of said form rollers endways relative to said first hard rollers, said second hard rollers and said plate cylinder.

18. An offset lithography method including the steps of:

rotating a plate cylinder of an offset lithography press;

oscillating form rollers of the offset lithography press endways relative to said plate cylinder while maintaining engagement between said form rollers and said plate cylinder; and maintaining rotatable, non-oscillating hard rollers of the offset lithography press in engagement with said oscillating form rollers.

19. The method according to claim 18 wherein said offset lithography press includes a plurality of ink transfer rollers in operative association with said hard rollers and said form rollers to deliver ink to said plate cylinder, said method including the step of oscillating said ink transfer rollers endways relative to said hard rollers and said plate cylinder.

* * * * *